United States Patent [19]

Vadasz Fekete

[11] Patent Number: 4,591,316

[45] Date of Patent: May 27, 1986

[54] PISTON WITH SIMPLE RETENTION VALVE

[76] Inventor: Amnon M. Vadasz Fekete, Av. Principal de Sebucan, Resid. Jardines de Sebucan, Apto. 7-D, Urb. Sebucan., Caracas, Venezuela

[21] Appl. No.: 427,158

[22] Filed: Sep. 29, 1982

[51] Int. Cl.[4] ..... F04B 3/00; F04B 7/00

[52] U.S. Cl. ..... 417/259; 417/513; 417/514; 417/520

[58] Field of Search ..... 417/510, 259, 511, 512, 417/514, 520, 545, 552, 513

[56] References Cited

U.S. PATENT DOCUMENTS

| | | | |
|---|---|---|---|
| 61,209 | 1/1867 | Kelly | 417/511 |
| 573,860 | 12/1896 | Chapman | 417/512 |
| 706,861 | 8/1902 | Sotte | 417/512 |
| 1,221,843 | 4/1917 | Dierks | 417/511 |
| 1,538,855 | 5/1925 | Jackson | 417/511 |
| 1,580,915 | 4/1926 | Pledger | 417/513 |
| 1,663,610 | 3/1928 | Phelps | 417/513 |
| 1,738,167 | 12/1929 | Berkey | 417/513 |
| 1,793,572 | 2/1931 | Von Linde | 417/259 |
| 2,090,209 | 8/1937 | Larson et al. | 417/511 |
| 2,775,212 | 12/1956 | Hilton | 417/513 |
| 2,791,970 | 5/1957 | Hunter | 417/513 |
| 2,933,050 | 4/1960 | Crowl et al. | 417/513 |
| 3,109,384 | 11/1963 | Adams | 417/511 |
| 4,332,533 | 1/1982 | Spears | 417/513 |

*Primary Examiner*—William L. Freeh

*Attorney, Agent, or Firm*—Baker & McKenzie

[57] ABSTRACT

A positive displacement pump particularly useful in pumping viscous fluids which may or may not contain gases, including water vapor, and/or suspended solids in which the actual flow equals the theoretical maximum flow through a check valve associated with the pump, said pump including a piston having a plug valve incorporated therein which has limited reciprocable movement within an extension of the piston, the flow area within the piston downstream from the plug being proportioned, by restriction if necessary, to equal the flow area past the plug.

2 Claims, 1 Drawing Figure

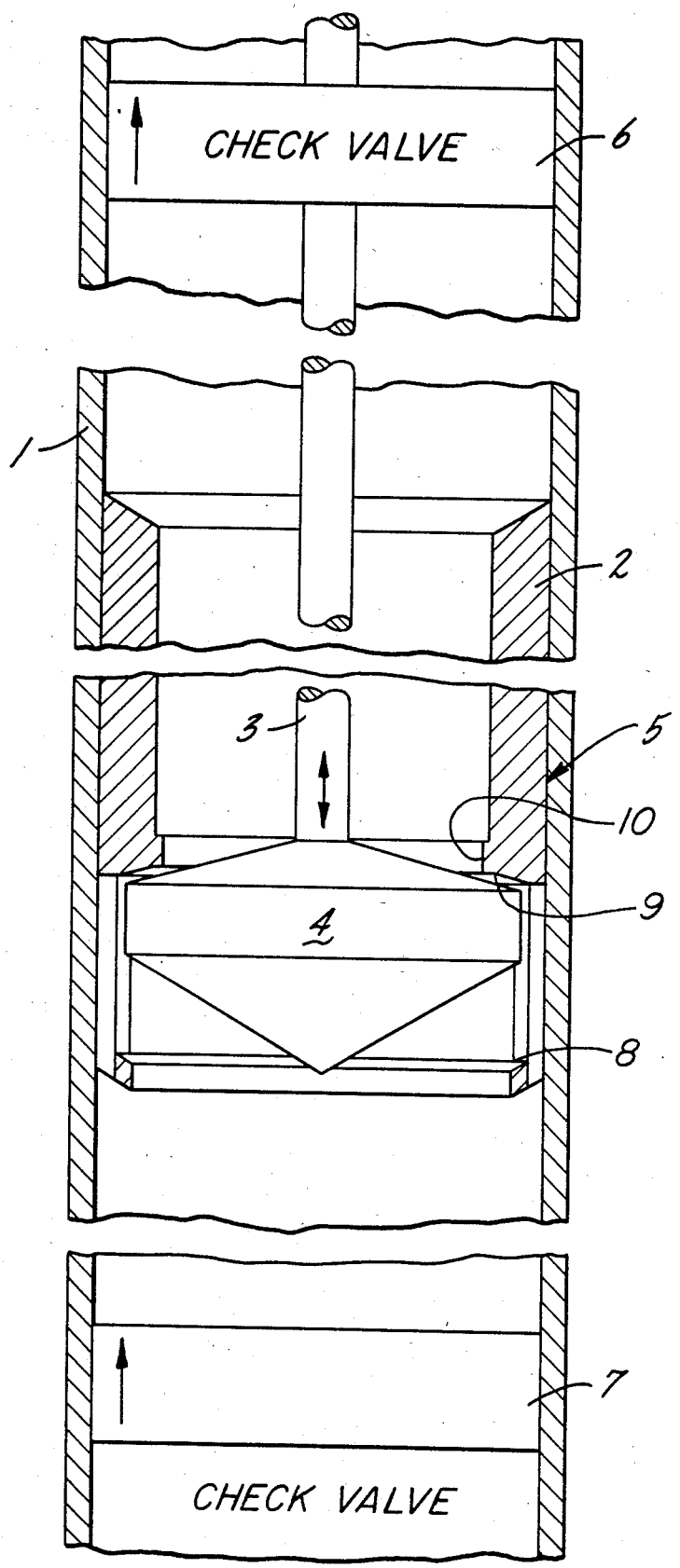
CHECK VALVE
6
1
2
3
5
10
9
4
8
7
CHECK VALVE

PISTON WITH SIMPLE RETENTION VALVE

SUMMARY OF THE INVENTION

The objective of the present invention is to resolve the limitations of the pistons present in pumps (or compressors) using the principle of positive displacement, in order to provide for a pump (or compressor) with optimal pressure ratio and to maximize the area of possible flow through a simple retention valve secured to the piston.

The piston which meets the objectives of the present invention is constituted by a cylindircal body which is displaced within another cylinder, a stem which transmits a periodic movement to a plug which can contact the cylindrical body through a seat, in one direction, and through any other method which can transmit the movement of the stem of the cylindrical body in the other direction.

The piston which in the object of this invention, together with a retention valve secured to the cylinder, within which the piston is displaced, will constitute a pump which may be used for pumping viscous fluids with or without contents of suspended solids. If another retention valve is secured in the cylinder within which the piston is displaced, so that the piston is displaced between the two retention valves, then the pump (or compressor) will also be able to pump fluids with a high contents of dissolved gases and/or water vapor.

For a better understanding of this invention, a possible embodiment of same and its operation will be described, when same will form part of a pump (or compressor), with the understanding that this presentation is merely for explanatory purposes and is in no way limitative.

BRIEF DESCRIPTION OF THE DRAWING

FIG. 1 is a diagram of the component parts of the present invention.

DETAILED DESCRIPTION OF THE INVENTION

FIG. 1 represents a possible design of the piston, which is the subject of the invention. The piston is displaced inside a fluid flow conduit or cylinder 1 and formed by a cylindrical body 2, a stem 3 and a simple retention plug 4. The plug 4 and the cylindrical body 2 where it is seated constitute the traveling retention valve 5; the traveling retention valve 5 may also hereinafter sometimes be referred to as the plunger 5.

Since the travleing valve 5 is located in the suction end of the piston, the pressure ratio in the pump is optimal.

The free space between the stem 3 and the interior of the cylindrical body 2 is the only factor which limits the flow area through the piston; that is, the area of the inside diameter of the cylinder 2 minus the area of the stem, or plunger reciprocating means, 3 is the theoretical maximum flow area through the plunger. As is apparent from the Figure, said area may be described as a generally uninterrupted annular flow area it is possible to optimize the flow area through the traveling valve 5 taking as a limiting factor the space which exists between the plug 4 and the cylinder 1; that is, said space, which is the area of the inside diameter of the cylinder 1 minus the area of the plug 3, when equal to the area of the inside diameter of the cylinder 2 minus the area of the stem 4, will provide the optimal, or maximum flow through the plunger. When the flow area between the plug 4 and the cylinder 1 is equal to the flow area between the stem 3 and the interior of the cylindrical body 2, the flow is optimized. That is, the cross section area between the plug 4 and cylinder 1 is made equal to the minimum internal cross section area of sleeve 2, which minimum internal cross section area is established by the inwardly extending shoulder 10. The sleeve 2 has a maximum internal cross section area as can be readily seen from the figure. If necessary the flow area between the cylinder 2 and the stem 3 may be reduced by reducing the inner diameter of the portion of the cylindrical body 2 where the plug is seated, as by the small shoulder, unnumbered, at the lower end of cylinder 2 is indicated in FIG. 1.

The operation of the piston, the subject of the invention, is hereinafter described when it is applied to pumps in which the stem is moved in a vertical direction, like in the underground pumps used in the petroleum industry. The explanation of the operation is valid for all pumps (or compressors) using the principle of positive displacement. If the stem is moved in a direction other than vertical, then only the gravitational components which actuate in the vertical direction need to be considered.

During the operation of the pump, when the stem 3 commences to descend from the extreme upper position, the annular retention valve 6 (secured to the cylinder 1 on the discharge side of the piston) which is used optionally when there is a high content of gases and/or water vapor dissolved in the fluid, is closed. Closure of check valve 6 starts to support the effects of the counterpressure and of the weight of the fluid column located above the valve 6; meanwhile, the piston descends by the mechanical action of the stem 3, aided by the action of the weight of the reduced fluid column located between the traveling valve 5 and the check valve 6 or by any fluid column when the check valve 6 is not used, until the increase of the pressure between the retention valve 5 and the stationary pressure responsive check valve 7 (secured to the cylinder 1 on the suction side of the piston) and primarily the friction between the cylindrical body 2 of the piston and the cylinder 1 stops the movement of said cylindrical body 2. When the latter is detained, the plug 4, which is secured to the stem 3, is separated from its seat in the cylindrical body 2 and continues to descrend until said plug 4 or any other means again establishes contact with the cylindrical body 2 at an extension 8 integral herewith, transmitting thus the descent movement to the piston. The opening of the traveling valve 5 is forced and not due to the difference of pressures. Therefore, the fluids which may be present within the cylinder 1 between the traveling valve 5 and the fixed valve 7 do not have to be compressed. As the piston descends, said fluids flow through the traveling valve 5 and the cylindrical body 2.

Once the piston reaches its extreme lower position and the stem 3 starts to rise, the plug 4 closes the traveling valve 5 as soon as it makes contact with the seat of the cylindrical body 2 and imparts the ascending movement upon the piston; all this occurs when the relative speed of the fluid at both sides of the valve is zero. As said piston rises, a drop of pressure is going to be created inside the cylinder 1 between the traveling valve 5 and the stationary check valve 7 until this pressure is less than the tank's own pressure (any container or location where the fluids are located). Then this latter valve 7 will open, allowing the flow of the fluids from the tank to the interior of the cylinder 1. Meanwhile, if check valve 6 is used, as when the contents of gas and/or water vapor so merits it, the fluid present inside the cylinder between the traveling valve 5 and the check valve 6 is going to be compressed until the pressure in the area will be higher than the counterpressure effects and higher than the weight of the fluid column which acts on the check valve 6, in which case the valve opens and allows for the outflow of the fluid.

Finally, when the piston reaches the extreme upper position and commences to descend, the fixed valve 7 closes and the pumping cycle is repeated.

The advantages of the present invention are:

1. Prior to the start of the suction cycle of the piston, the stem 3 causes movement of the plug 4 which is displaced toward its seat in the cylindrical body 2, and it starts to close the opening of the plunger 5. All this takes place when the relative velocity of the fluid, on both sides of the retention valve, is zero; therefore, the erosion effects of the fluid upon the components of the piston are practically eliminated.

2. since the traveling retention valve, located in the piston closes prior to the start of the suction stroke of the piston the pumped volume is practically the maximum volume.

3. If the pumped fluid contains a high content of gases and/or water vapor, the fact that the traveling retention valve opens in a forced manner (mechanically), and not by difference in pressures, eliminates in piston stroke the possible condition of blocking by gases and/or water vapor.

4. If the pump is installed so that the stem is moved in a direction other than horizontal, the possibility exists that solids suspended in the fluid may be deposited on the traveling retention valve. The position of the plug 4 in the piston is such that the flow of fluid can relieve, this condition.

5. The shape of the plug may be designed in such a manner that the traveling valve presents the maximum area of flow which is permitted with a simple retention plug and offers optimal characteristics with respect to the dynamic of the fluids.

I claim:

1. A positive displacement retention valve pump apparatus in which the actual flow equals the theoretical maximum flow through the retention valve, said apparatus inclduing, in combination, a confined fluid flow conduit, a piston adapted for reciprocal movement within the fluid flow conduit between upstream and downstream limit positions, piston reciprocating means, and pressure responsive check valve means located upstream with respect to the piston in the fluid flow conduit, said pressure responsive check valve means being operable to permit fluid flow therethrough in a downstream direction toward the piston, and to preclude fluid flow therethrough in an opposite direction, said piston being composed of a plurality of parts which are relatively movable with respect to one another, said piston including a simple retention valve consisting of a plug means, a cylinder having a minimum and a maximum internal cross section flow area therein and being reciprocable within the confined fluid flow conduit, and a seat on the cylinder for the plug means, said piston reciprocating means being operatively connected to the plug means, said piston being arranged to close, and thereby block the fluid flow conduit, prior to the suction stroke of the piston, the flow area between the plug means and the fluid flow conduit being equal to the flow area between the plunger reciprocating means and the minimum internal cross sectional flow area of the cylinder downstream from the cylinder seat whereby the flow through the piston is optimized.

2. The positive displacement simple retention valve pump apparatus of claim 1 further characterized by and including a second pressure responsive check valve means located downstream with respect to the piston in the fluid flow conduit, said second pressure responsive check valve means being operable to permit fluid flow therethrough in a downstream direction away from the piston, and to preclude fluid flow therethrough in an opposite direction.

* * * * *